US005533365A

United States Patent [19]

Sangiacomo

[11] Patent Number: 5,533,365

[45] Date of Patent: Jul. 9, 1996

[54] DEVICE FOR CUTTING THREADS IN CIRCULAR STOCKING KNITTING MACHINES

[75] Inventor: Fulvio Sangiacomo, Brescia, Italy

[73] Assignee: Sangiacomo S.p.A., Brescia, Italy

[21] Appl. No.: 502,189

[22] Filed: Jul. 13, 1995

[30] Foreign Application Priority Data

Jul. 14, 1994 [IT] Italy ..... BS94A0087

[51] Int. Cl.[6] ..... D04B 35/00; D04B 35/34

[52] U.S. Cl. ..... 66/145 R; 66/140 R; 83/592

[58] Field of Search ..... 66/134, 140 R, 66/140 S, 142, 143, 145 R; 83/592

[56] References Cited

U.S. PATENT DOCUMENTS

| | | | |
|---|---|---|---|
| 1,727,783 | 9/1929 | Pulster | 66/145 R |
| 1,945,971 | 2/1934 | Gagne | 66/145 R |
| 3,225,571 | 12/1965 | Mahler | 66/145 R |
| 3,382,685 | 5/1968 | Albini et al. | 66/145 R |
| 4,085,598 | 4/1978 | Minton | 66/145 R |

*Primary Examiner*—John J. Calvert
*Attorney, Agent, or Firm*—McGlew and Tuttle

[57] ABSTRACT

A device for cutting threads in circular stocking knitting machines, which includes a circular saw having teeth on its periphery and at least one knife. Each tooth of the saw has a cutting zone away from and moved back with respect to the front part. The front part is intended for gripping and dragging along the thread towards the knife. Between the front part and the cutting zone of each tooth, there is provided a notch or step, which is intended for holding a piece of thread without being intercepted by the knife. The cutting zone interacts with the knife for cutting the thread away from the front part, when the thread rests on the cutting zone.

2 Claims, 1 Drawing Sheet

DEVICE FOR CUTTING THREADS IN CIRCULAR STOCKING KNITTING MACHINES

FIELD OF THE INVENTION

The present invention refers to the sector of circular stocking knitting machines and more specifically it pertains to an improvement in the device for cutting the threads in such circular machines during knitting.

BACKGROUND OF THE INVENTION

The circular stocking knitting machines, whether they are single feed or multiple feed, are usually provided with a device for cutting the threads, which consists of a circular saw having teeth facing towards the outside and of one or more knives having the function of a counterblade. The saw is fixed and rotates with the plate, while the knife remains stationary. Therefore, any tooth of the saw can, with its front part, intercept the thread that comes close to it as a result of an appropriate movement of the relative thread guide, and interacting with the fixed knife, cuts the thread.

Normally, the length of the tail of the thread that remains when cut is that from the outlet point of the thread from the needles to the cutting of the tooth of the saw, which coincides with the front part of the tooth which grips the thread and which interacts with the knife for the cutting. However, the distance between the needles and the saw teeth is often limited, and the tail of the cut threads can be too short. In some knitting operations, especially in the presence of elastic threads, such a tail of the threads, if it is too short after the cutting, can become unthreaded from the knitting, and from the reverse side to the right side of the manufactured article.

SUMMARY AND OBJECTS OF THE INVENTION

It is an object of the present invention to remedy such a drawback through a new, original structure of the saw and more specifically of its teeth.

Another object of the present invention is to propose a thread-cutting saw for circular stocking knitting machines modified in such a way that each of its teeth, in addition to dragging the thread with its upper part, are able to hold a piece of thread horizontally before this piece is cut with the aid of the knife, so as to increase the length of the tail of the remaining thread.

According to the present invention, the objects are achieved

- by moving back the cutting zone of each tooth of the saw as regards the front part of the tooth which is intended for gripping and dragging along the thread towards the knife,
- by making, between the front part and the cutting zone of the tooth, a notch or step, in which a piece of thread is carefully placed above the cutting zone, and
- by cutting the thread with the aid of the knife at the level of the cutting zone of the tooth away from the front part.

The thread is cut by means of the knife away from the front part of the tooth and the length of the remaining thread tail is no longer equal to the distance between the needles and the saw teeth, that is, between the point of outlet of the thread from the needles of the machine and the front part of the tooth, but it is equal to such an increased distance of the piece of thread that is held by the notch or step of the tooth. This results from an increase in the distance between the front part and the cutting zone of the tooth. Therefore, with a suitable selection of the distance between the front part and the cutting zone, the length of the notch or step, the threads can be cut to a length such that their tails do not become unthreaded from the knitting and pass from the reverse side to the right side.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
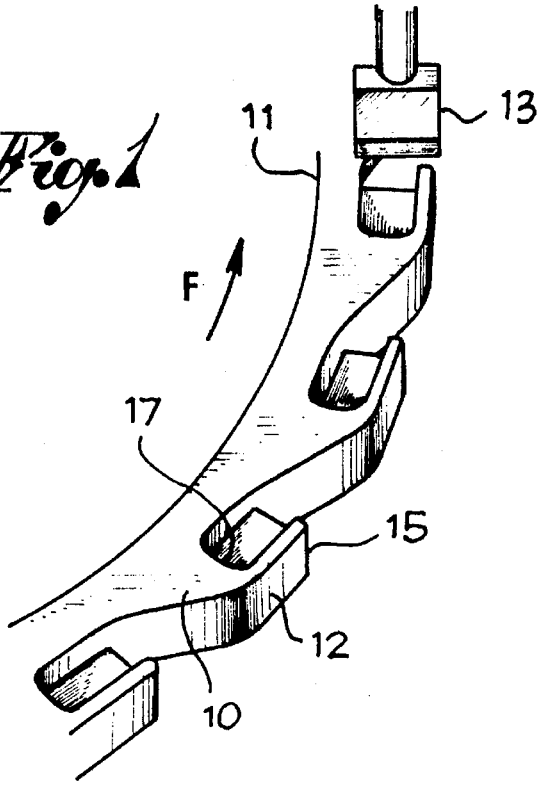
FIG. 1 is a section of the saw in an enlarged perspective view.
Figure 2:
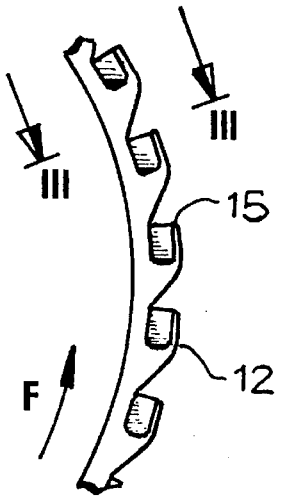
FIG. 2 is a plane view of a part of the saw in Figure.
Figure 3:
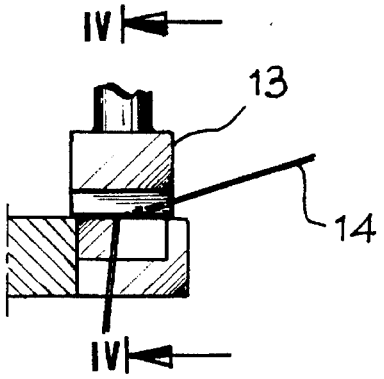
FIG. 3 is an enlarged section according to the arrows III—III in FIG. 2.

The saw consists of an annular body 11, having on its periphery a plurality of teeth 12. The saw is fixed and rotates with the plate of a circular stocking knitting machine, and its teeth are intended for interacting with at least one fixed knife 13, which acts as a counterblade, for the cutting of threads 14.

Considering the direction F of rotation of the saw, each tooth 12 of the saw has a radial front part 15 intended for gripping the thread 14 to be cut and for dragging it along towards the knife 13 when the thread guide moves the thread into a position of interception by any tooth of the saw. The knife 13 is usually arranged above the saw in correspondence to the teeth 12 so as to touch their upper surface 16 while the saw rotates with the plate, to which it is fixed.

Figure 4:
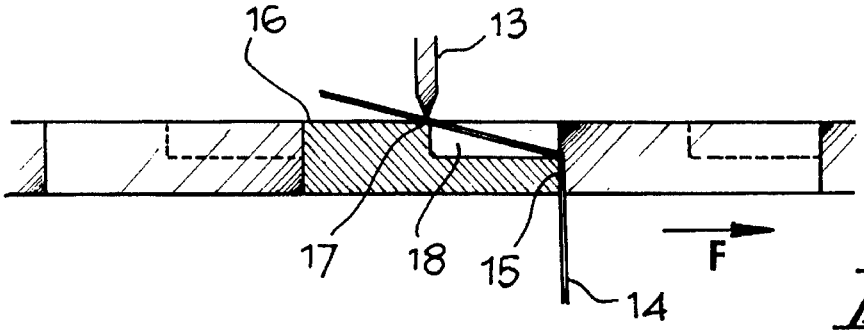
FIG. 4 is a section, also enlarged, according to the arrows IV—IV in FIG. 3.

According to the present invention and as shown in the drawings, a notch or step 17, which extends backwards (with respect to the direction of rotation) from the front part 15 up to a cutting zone 18, is made on the upper surface 16 of each tooth 12. The cutting zone 18 of each tooth is thus spaced away (backwards) from the front part 15, and the notch or step 17 can hold a corresponding piece of thread 14. The fixed knife 13 passes over the notch or step 17 without affecting the thread 14. Moreover, the knife 13, when it corresponds to the cutting zone 18, touches it, and interacting with same as blade-counterblade, cuts the thread (cf. FIG. 4). The thread is thus cut away from the front part of the tooth that drags it along, for which reason the remaining tail of the thread will certainly be longer than it would be if the thread were cut at the level of the front part of the tooth as occurs with the prior-art saws.

While a specific embodiment of the invention has been shown and described in detail to illustrate the application of the principles of the invention, it will be understood that the invention may be embodied otherwise without departing from such principles.

What is claimed is:

1. A device for cutting threads in a circular knitting machine comprising:

a circular saw having teeth;

said saw being fixed for rotation with a plate of the circular knitting machine;

each of said teeth of the saw having a front part for gripping and dragging one of the threads toward a fixed knife, acting as a counterblade, and an upper surface;

said fixed knife being positioned to touch said upper surface of said teeth of the saw;

said each of said teeth further comprising a notch between said front part and said upper surface forming a cutting zone and an area in which the thread is free of interception by said fixed knife; and wherein said cutting zone interacts with the knife for cutting the thread at a distance from said front edge.

2. A device according to claim 1, wherein said notch is formed on a surface of said tooth facing said knife, said knife being positioned in order to touch said cutting zone a distance from said front part for dragging.

* * * * *